US009384660B2

(12) United States Patent
Fossier et al.

(10) Patent No.: US 9,384,660 B2
(45) Date of Patent: Jul. 5, 2016

(54) MIRROR ALERT WITH PROJECTED MESSAGE

(71) Applicants: David A. Fossier, Cincinnati, OH (US); William Chernick, Cincinnati, OH (US)

(72) Inventors: David A. Fossier, Cincinnati, OH (US); William Chernick, Cincinnati, OH (US)

( * ) Notice: Subject to any disclaimer, the term of this patent is extended or adjusted under 35 U.S.C. 154(b) by 38 days.

(21) Appl. No.: 14/561,838

(22) Filed: Dec. 5, 2014

(65) Prior Publication Data

US 2015/0154863 A1 Jun. 4, 2015

Related U.S. Application Data

(63) Continuation-in-part of application No. 13/178,684, filed on Jul. 8, 2011, now Pat. No. 8,905,568, which is a continuation-in-part of application No. 11/437,093, filed on May 19, 2006, now abandoned.

(60) Provisional application No. 60/685,516, filed on May 27, 2005.

(51) Int. Cl.

| | |
|---|---|
| ***F21V 33/00*** | (2006.01) |
| ***G08G 1/095*** | (2006.01) |
| ***G09F 9/33*** | (2006.01) |
| ***G09F 13/12*** | (2006.01) |
| ***G08G 1/16*** | (2006.01) |

(52) U.S. Cl.

CPC ..... *G08G 1/095* (2013.01); *G08G 1/164* (2013.01); *G09F 9/33* (2013.01); *G09F 13/12* (2013.01); *Y10S 362/802* (2013.01); *Y10S 362/812* (2013.01)

(58) Field of Classification Search

CPC . Y10S 362/802; Y10S 362/812; G09F 13/12; G09F 27/00

USPC ..... 362/135–144, 459–549, 802, 812

See application file for complete search history.

(56) References Cited

U.S. PATENT DOCUMENTS

| | | | |
|---|---|---|---|
| 4,779,176 | A | 10/1988 | Bornhorst |
| 5,367,349 | A | 11/1994 | Zeiler |
| 5,572,202 | A | 11/1996 | Regel et al. |
| 7,086,750 | B2 | 8/2006 | Leyden et al. |
| 7,423,522 | B2 | 9/2008 | O'Brien et al. |
| 7,699,141 | B2 | 4/2010 | Fossier et al. |
| 8,768,559 | B1 | 7/2014 | Murphy |
| 2002/0175825 | A1 | 11/2002 | Clerk et al. |
| 2006/0071766 | A1 | 4/2006 | O'Brien et al. |
| 2006/0133072 | A1 | 6/2006 | Leyden et al. |
| 2014/0204347 | A1 | 7/2014 | Murphy |

OTHER PUBLICATIONS

Internet Brochure for LTBL Tech LIGHTCOP Radar-Controlled Traffic Management and Warning System (visited Oct. 13, 2015) <http://www.ltbltech.com/>.

(Continued)

*Primary Examiner* — William Carter

(74) *Attorney, Agent, or Firm* — John B. Woodard; Jon L. Woodard; Woodard International Law

(57) ABSTRACT

An apparatus includes a mirror dome and a light producing system for producing and transmitting light through the mirror dome to an external surface to produce a message viewable on the external surface. A sensing system identifies traffic and is in communication with the light producing system to cause the light producing system to produce and project a message viewable on the external surface when the sensing system detects approaching objects or traffic.

41 Claims, 7 Drawing Sheets

(56) References Cited

OTHER PUBLICATIONS

Internet Web Page for QUNOMIC Virtual Technologies (visited Oct. 13, 2015) <http://steingroup.us/qunomic/index.php>.

Internet Web Page for SIGNCAST Virtual Signs (visited Oct. 13, 2015) <http://www.creativesafetysupply.com/signcast-virtual-signs/>.

Domes & Mirrors by Se-Kure Brochure (May 14, 2003).

Alert Safety Products Forklift Warning Systems Brochure (2013).

Alert Safety Products Product/Service Information Brochure (2012).

MIRROR ALERT WITH PROJECTED MESSAGE

CROSS REFERENCE TO RELATED APPLICATIONS

This is a continuation-in-part application of co-pending U.S. patent application Ser. No. 13/178,684, filed Jul. 8, 2011, which is incorporated herein by reference and which is a continuation-in-part application of U.S. patent application Ser. No. 11/437,093, filed May 19, 2006, which is also incorporated herein by reference and which claims the benefit of U.S. Provisional Patent Application No. 60/685,516, filed May 27, 2005, which is further incorporated herein by reference.

BACKGROUND

When forklifts are used in an industrial environment such as a factory or a warehouse situation, they usually occupy a space that is populated not only with forklifts but with other moving things as well. These can comprise a wide variety of moving objects such as powered and unpowered utility carts, bicycles, golf carts and even people. Wherever there are moving objects such as these, there is always a danger of collision between them. Particularly severe collisions can happen when the moving objects are massive, such as when forklifts collide, and injuries can occur if a person is involved in a collision.

The danger of collisions is manifest at intersections on a factory or warehouse floor, especially, when views are inhibited by items adjacent the intersections that obscure oncoming traffic approaching the intersections.

Prior art for warning of or seeing approaching traffic at intersections has included traffic signals, various mirror arrangements for observing traffic, floor embedded sensors for triggering warnings, auditory warning systems, and sensors distributed around the areas of approach to intersections. These have been used to trigger various warning devices from signs to whistles.

Installation of these systems is often expensive and time consuming. The installation usually requires significant wiring over a plurality of approaches and a central control unit with the wiring often subject to damage in the industrial environment. In addition the distributed sensors on which they depend are easily blocked or damaged due to their distribution around the area of the intersection with some of them necessarily disposed at low levels where they can easily be hit or damaged by activities occurring in the industrial environment.

A reliable and robust apparatus for detecting and warning of the presence of traffic that approaches the intersection outside the line of sight of one approaching the intersection is needed. This system should be able to detect and distinguish between the kind of traffic that is approaching the intersection, the sizes of objects approaching the intersection and various properties of the objects approaching such as speed and composition. The apparatus should further be able to distinguish whether the traffic is approaching or departing the intersection. The apparatus should then be able to warn of the approach of objects that might be out of the line of sight of one approaching the intersection and designate the positions of the other approaching traffic.

Further, the apparatus should be easily installable requiring little time or skill on the part of the installer. Most desirable would be a single integrated unit not requiring the disposition of various parts of the apparatus about the intersection, but nevertheless allowing for the projection of warning information to surfaces or locations separated from the apparatus. Particularly, extensive on-site wiring of detectors, sensors, and the like should be avoided.

The apparatus should offer direct visual identification of the traffic approaching the intersection. This would be best accomplished by providing projected information regarding the approaching traffic in addition to a warning even if the intersection comprises acute, right, or obtuse angles between intersecting pathways.

Those who routinely work in or manage an industrial situation where traffic must pass through intersections will recognize that such improvements in intersection warning systems are needed.

SUMMARY

An apparatus for seeing and for warning of traffic crossing at an intersection is provided. The apparatus comprises a partially transparent mirror dome with an outside surface for reflecting incident light and an inside surface that receives light from inside the mirror dome and passes the light through the mirror dome.

A light producing system is used for producing and transmitting light through the mirror dome so that the light is projected through the mirror dome to a surface that is separated from the mirror dome, such as to the ground below or to an adjacent floor, wall, walkway, street, road, or transit way. The projected light is then visible when viewing the surface that is separated from the mirror dome. The light producing system uses the projected light to display a message that is visible when viewing the surface that is separated from the mirror dome.

A sensing system is used for identifying traffic crossing at the intersection. The sensing system includes a microwave sensor to identify the nature of approaching objects and traffic and to differentiate between approaching and departing and metal and non-metal objects and traffic. The sensing system is also in communication with the light producing system to cause the light producing system to produce and project messages viewable on the surface separated from the mirror dome when the sensing system detects approaching objects or traffic. The message provided and projected by the light producing system indicates the direction of approaching traffic and object travel and further indicates information regarding the approaching traffic and objects.

The apparatus is capable of discriminating traffic approaching the mirror dome from at least one direction and projecting a message visible in at least one other direction to warn about the traffic approaching the mirror dome. Of course, a reflection of approaching traffic can be seen from the outside surface of the mirror dome. The apparatus is also capable of displaying messages warning of the approach of traffic from multiple directions simultaneously.

An apparatus for surveillance and advertising in commercial environments is provided having a partially transparent mirror dome with an outside surface for reflecting incident light and an inside surface for receiving and passing light from inside the mirror dome. The apparatus further comprises a light producing system for producing and transmitting light through the mirror dome wherein the light is projected through the mirror dome to a surface in the commercial environment that is separated from the mirror dome. Such surface can be, for example, the ground below, an adjacent floor, wall, sign, counter space, walkway, street, road, store aisle, or transit way. The projected light is then visible when viewing the surface that is separated from the mirror dome. The light producing system uses the projected light to display an advertising or surveillance-related message that is visible when viewing the surface that is separated from the mirror dome.

A sensing system identifies the approach of a customer toward the mirror dome. The sensing system includes a microwave sensor to identify the nature of the approaching customer objects and traffic. The apparatus can differentiate between metal and non-metal objects and customer traffic and can further differentiate between whether the objects and customer traffic are approaching or departing from the mirror dome.

The sensing system communicates with the light producing system, causing the light producing system to produce and project messages viewable on the surface of the commercial environment separated from the mirror dome when the sensing system detects objects and customer traffic approaching the mirror dome. The projected message can be used for advertising purposes and for alerting purposes, and may be tailored as appropriate for the detected customer or object approaching. A reflection image is also visible in the outside surface of the mirror caused by the exterior light incident on the mirror.

BRIEF DESCRIPTION OF THE DRAWINGS

For a more complete understanding and appreciation of this invention, and many of its advantages, reference will be made to the following detailed description taken in conjunction with the accompanying drawings.

DETAILED DESCRIPTION

Figure 1:
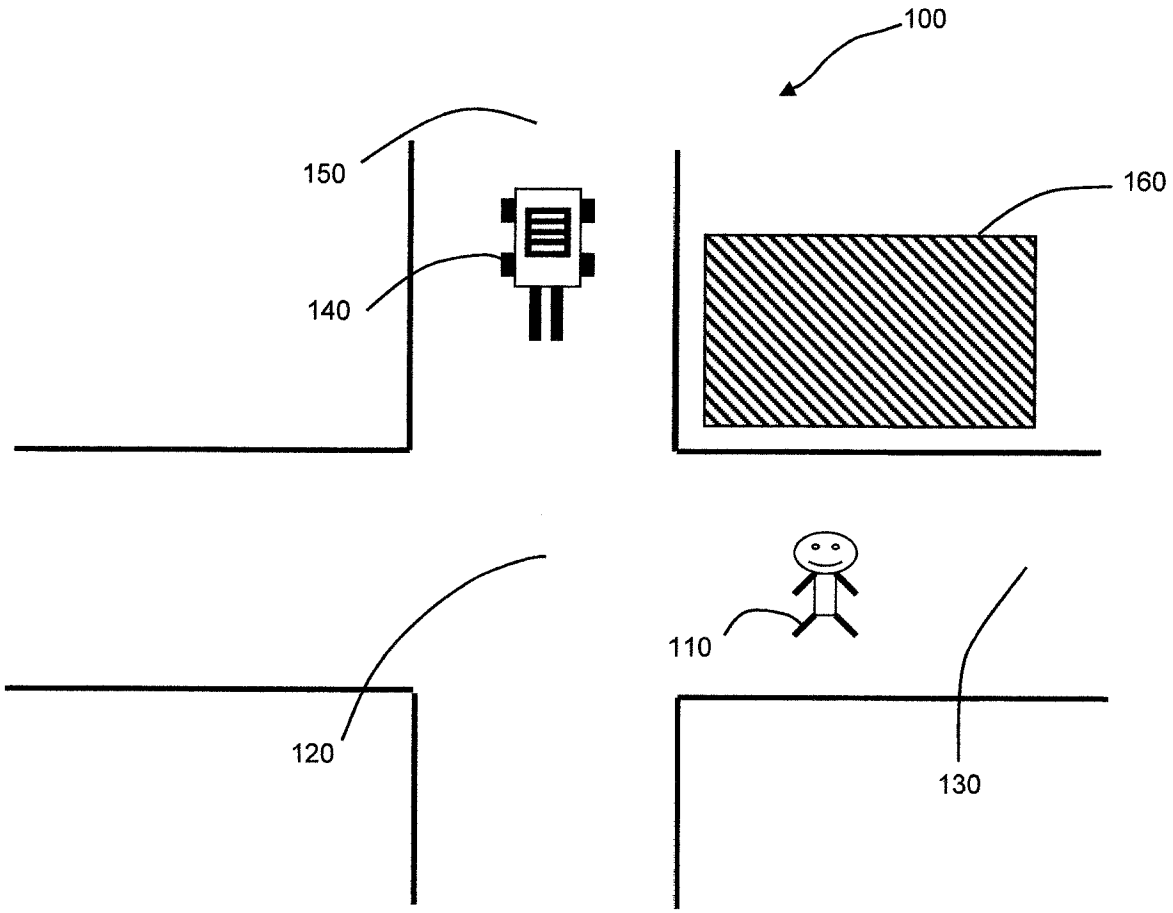
FIG. 1 is a top view diagram of a four way intersection of the type in which the invention can be utilized for providing warning information to an individual pedestrian and a forklift vehicle operator.

Referring to the drawings, identical reference numerals are often used to designate some corresponding parts throughout the several embodiments and figures shown and described. In some figures, some specific embodiment variations in corresponding parts are denoted with the addition of lower case letters to reference numerals.

According to the invention, an apparatus for seeing and warning traffic crossing at an intersection in a commercial, industrial or other space is used to improve worker safety and to avoid costly damage due to collisions at the intersection. For example, the apparatus could be used in a factory or warehouse with the effect of not only avoiding personal injury or property damage, but also to have the effect of significant cost savings in premiums for insurances such as physical damage insurance or workers' compensation insurance. The invention is concerned with systems that warn people approaching an intersection of the approach of other traffic that might not be seen as one approaches the intersection.

Along with preventing accidents in the general movement of individuals walking or using other means of conveyance, the invention works to avoid collisions involving forklifts or any kind of motorized industrial truck that, when in use, sometimes limit the vision of their operators leading to safety issues of operation and requiring extensive education of their operators to preserve safety and comply with federal law.

The invention can provide images of traffic approaching an intersection, an optically presented warning message regarding the other traffic's approach, an auditory warning, an identification of the nature of the traffic approaching, other data regarding the approaching traffic such as speed, dimension, and composition, whether the traffic is approaching or departing, handle multiple approaching traffic simultaneously, and using appropriate logic circuitry adjust the message presented as desired to maximize safety at the intersection.

In some embodiments, the apparatus can be an integrated unitary package in which all the elements comprising the apparatus are disposed adjacent one another, attached together by a frame that supports all the elements in a single mountable unit intended to occupy a central position in the intersection. The unitary package, comprising the entire apparatus, can be designed for ease of installation by untrained personnel with the provision of power to the unitary apparatus as the only wiring requirement.

The invention contemplates an apparatus comprising a partially transparent mirror that can present a curved outer surface or a plurality of surfaces of different or equal curvatures. The mirror is usually constructed to insure that one side of the mirror, often called the front side of the mirror, is highly reflective. Further, the mirror is designed to reflect light incident on the outside of the mirror to the extent possible, but in most cases will allow part of the light to pass through the mirror by virtue of its transparency. The other side of the mirror, often called the backside, can be reflective but is designed to allow light incident thereon to be transmitted through the mirror passing through the front side of the mirror.

Some contemplated embodiments utilize a spherical dome, or mirror dome, sometimes referred to mathematically as a spherical segment, which can be interpreted as a segment of a sphere and can be defined by the spherical radius of the sphere of which the mirror is a segment. To be structurally viable, the mirror dome is constructed with sufficient thickness. When the mirror dome is of uniform thickness, the mirror segment can be defined by either its inner or outer radius combined with the thickness of the mirror dome.

As described above, the mirror dome is partially transparent with the outer surface of the mirror dome intended to be highly reflective to provide images visible in the mirrored surface of objects disposed about the mirror.

The inner surface of the mirror dome, defined by the inner radius of the mirror, is intended to receive light from inside the mirror dome and transmit the light through the partially transparent mirror such that the source of the light is visible outside the mirror dome. Alternatively, the light can impinge on a coated surface or on an activatable surface such as a phosphor coating on the mirror to make the light appear when viewed outside the outer surface of the mirror dome to emanate from the outer surface of the mirror dome.

In some embodiments, the mirror dome can be a segment of a distorted sphere, which is not strictly defined by a constant radius.

A light producing system is disposed within the inside of the mirror. In some embodiments, the light producing system is intended to provide messages that can be read from outside the mirror and that are easily visible from outside the mirror.

Various sources can be used to create the light inside the dome of the mirror dome. For example, a display of light emitting diodes could be used to display an image such as a message via symbols and/or letters that would be visible from outside the mirror dome.

Another source, a laser, can also be used in some contemplated embodiments to excite a coated outer surface of the mirror dome thus effectively providing an image on it.

In some contemplated embodiments, a light source could be interrupted by a graphical overlay or series of overlays causing an image to appear from inside the mirror dome.

In many contemplated embodiments, the viewer outside the mirror dome is precluded from seeing the apparatus inside the mirror dome by the high ambient light reflectivity from the outer surface of the mirror dome and will only see the relatively bright light emitted by the light source within the dome or generally inside the apparatus. In this way the mirror will appear to have a message written on it or projected from it.

A sensing system is employed as a part of the apparatus for identifying traffic that approaches and/or departs the intersection. This sensing system can comprise a variety of sensor technologies for identifying the nature of the approaching traffic. Some technologies that can be employed for this are: microwave, photo sensors, magnetic loop, radio frequency, acoustic, radar, and laser.

It is contemplated that other sensor technologies could also be employed. The sensor system used must be able to distinguish the nature of the objects approaching the intersection.

The system should be able to differentiate between substantially metal objects and substantially non-metal objects. Such ability is valuable in distinguishing people from machines.

It is further contemplated that in many embodiments, the apparatus can distinguish the sizes of approaching objects. For example, in some embodiments, the system can distinguish among the sizes of a person, a bicycle, a golf cart, a service vehicle, sometimes called a "cushman," a powered industrial truck which is sometimes a forklift, and a scooter.

Further, it is contemplated that in some embodiments, the sensing system may also be able to determine whether an object is approaching or departing the intersection so that approaching traffic is not confused with departing traffic. Such confusion can lead to incorrect indications by the system and could lead to unwanted warnings regarding traffic in the vicinity of the intersection.

Once the sensing system has identified approaching traffic and the nature of the traffic, a message warning of the traffic and its nature can be displayed by the light producing system through the mirror dome. This message can be displayed in a direction or directions other than the direction from which the sensed traffic is approaching to make traffic approaching from the other directions aware of the presence of the traffic approaching from the original direction.

In like manner the other traffic approaching the intersection may also be sensed and identified by the sensing system and corresponding messages can be shown in directions other than the direction of approach.

For example, consider the crossing situation 100 in FIG. 1. If a person 110 is walking toward the intersection 120 along pathway 130 and a forklift 140 is approaching the intersection 120 from another direction along pathway 150 in a situation where the view of the person 110 and the forklift 140 operator is blocked by a view blocker 160 such as a stack of material, the apparatus will need to identify both the person 110 and the forklift 140 and will need to display messages to the person 110 and the forklift 140 operator warning of the presence of the other.

Of course, the system can be arranged to display warning messages in any set of different directions to satisfy safety requirements of the specific intersection being encountered by traffic.

FIG. 1 shows a simple crossing intersection 120, but an intersection could be much more complicated possibly having many additional directions of approach, and the apparatus could be configured to display warning messages in all or any particular needed subset of directions. It is contemplated the intersection could even have traffic arriving from different levels, such as, for example, an intersection involving arrival from ramps intersecting at the intersection or lifts arriving at or near the intersection.

Similarly, an intersection could have fewer directions of approach than in FIG. 1. However, warnings could still be needed. In such cases the apparatus can be adjusted accordingly.

In some cases the apparatus can be designed not to display a message even though the apparatus has detected and identified the nature of oncoming traffic. For example, the apparatus might detect persons walking toward the intersection, but because human traffic at the intersection represents limited risk of collision, the apparatus would not display a warning message. On the other hand, if, in this situation, a forklift was approaching the intersection from a different direction, messages could be displayed in the directions of both the walking person and the forklift operator to warn that the forklift and the person were approaching since a collision between a forklift and a person walking could be serious.

The apparatus can be arranged to only display messages for certain combinations of traffic. For example, if one of the items of approaching traffic comprises a substantial amount of metal such as a bicycle, a cart or a forklift, then the apparatus always displays warning messages regardless of the nature of the other traffic. But, in the example, if none of the approaching traffic comprises a substantial amount of metal, the apparatus can be arranged so that no messages are displayed.

Since in most cases the apparatus can distinguish the nature of the traffic, the nature of the traffic approaching can be displayed to the other traffic, whether it is a person, bicycle, forklift, or other traffic.

In each case the use of appropriately designed mirrors also allows those approaching around the periphery of the intersection to see an image of the approaching traffic in the mirror. This is especially true when using the mirror dome mentioned above. While such mirrors can preclude an image from directly ahead when approaching an intersection, it is the warning and image of traffic approaching from directions other than directly ahead that are needed to identify the possibly unseen traffic. Traffic approaching from directly ahead of one approaching the intersection can in nearly all cases be seen by those approaching. As a note, even traffic approaching from directly ahead can usually be seen in a mirror dome because the mirror dome is suspended above the intersection and thus offers an image of traffic approaching the intersection from all directions when viewed from below even when not directly beneath.

As noted above, the apparatus can display a variety of warnings. These can be hardwired so that a set of them can be simply displayed based on the nature of the traffic detected, or the apparatus can comprise logic based software to make decisions about the particular message or warning that is displayed. For example, display lighting apparatus can have a word and an arrow to display the nature of traffic and where it is located such as "Forklift →" when a forklift is approaching from the right.

Figure 2:
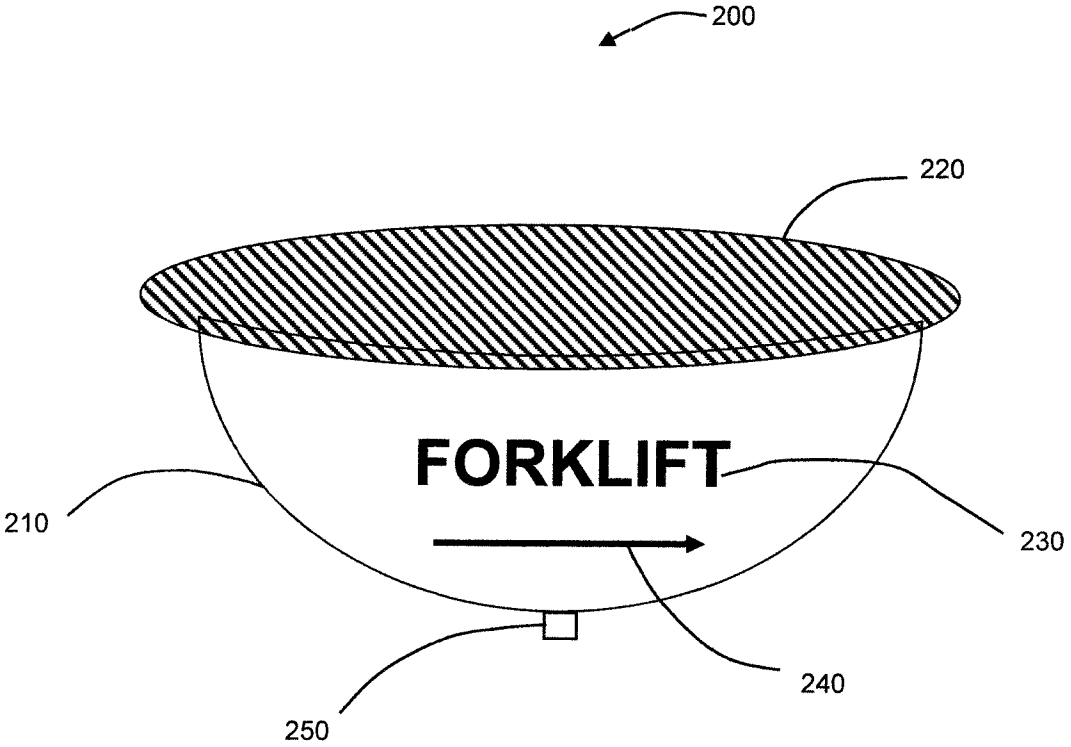
FIG. 2 is a side perspective view of a forklift warning apparatus according to one embodiment of the invention.

FIG. 2 shows a mirror dome apparatus 200 that can be used at an intersection with a mirror dome 210 suspended from a ceiling 220 with a forklift warning 230 and an arrow 240 imaged or projected to appear to be on the outside surface of the mirror dome 210. Note that FIG. 2 does not show the reflected images of the approaching traffic that would be seen in the mirror dome 210.

As mentioned above, the mirror dome can comprise a single dome of a single curvature or can comprise a combination of surfaces having a plurality of curvatures. Such mirror domes other than the common mirror dome in general would be used to satisfy a particular set of needs for a particular situation as it might occur.

In one contemplated embodiment the sensing system in communication with the light producing system turns off the warning message or messages when traffic is departing the intersection and no other traffic is approaching the intersection. The function of extinguishing the displayed message can also be accomplished by the use of a timer. However, for safety the timer arrangement must not extinguish the message when additional traffic is approaching the intersection from the direction that is being sensed by the system.

In another contemplated embodiment, a sound alarm is activated when traffic is sensed near the intersection. This is intended to help draw the attention to the mirror dome of the apparatus and its warning and reflected and self-generated images for added safety.

In another embodiment an indicator such as a pilot light 250, as shown in FIG. 2 is added to the system 200 so that those approaching the intersection know when the apparatus 200 is on and functioning. When a mirror dome 210 is used, this pilot light 250 can be incorporated in the bottom of the inverted dome 210 as shown in FIG. 2 so that it can be seen from any direction of approach. The pilot light 250 can use different signals or colors to indicate the condition of the apparatus 200. For example, when the pilot light 250 is steadily on, it could indicate that the apparatus 200 is on and functioning When the pilot light 250 is flashing, it could indicate the apparatus 200 is off and not functioning and that navigation through the intersection should be based on the reflected mirror images.

In yet another embodiment, discrimination reflectors can be placed on specific traffic that will be approaching the intersection to positively identify particular pieces of equipment or classes of equipment that could be passing through the intersection. The use of these discriminators can solve problems that might occur when the sensing system has trouble discriminating between different kinds of traffic. Also, the apparatus can be tied to or can incorporate electronic equipment for gathering data on specific traffic passing through the intersection. For example, a plant manager might want to know how many trips through the intersection a particular piece of equipment makes each day. The discriminator identifying that piece of equipment could gather the data needed.

It is contemplated that in some embodiments, the warning system can display a message giving the all clear if no traffic is detected. For example, if the system detects no substantially metallic traffic, the system could indicate that there is no metallic traffic and a quick check of the mirror would show any other traffic, such as people walking, that is approaching the intersection. Alternatively, a message indicating that it is safe to pass could be displayed if no dangerous traffic is detected approaching the intersection.

A logic system such as a computer can be incorporated in the apparatus to compose appropriate messages depending on detected traffic and traffic conditions. The logic system could provide messages based on such things as: type of traffic approaching the intersection, size of traffic approaching the intersection, proximity of approaching traffic to the intersection, and speed of traffic approaching the intersection. In addition an electronically produced image of traffic approaching the intersection could be provided via projection on an external viewing surface or via an image on a screen visible through the mirror.

Figure 3:
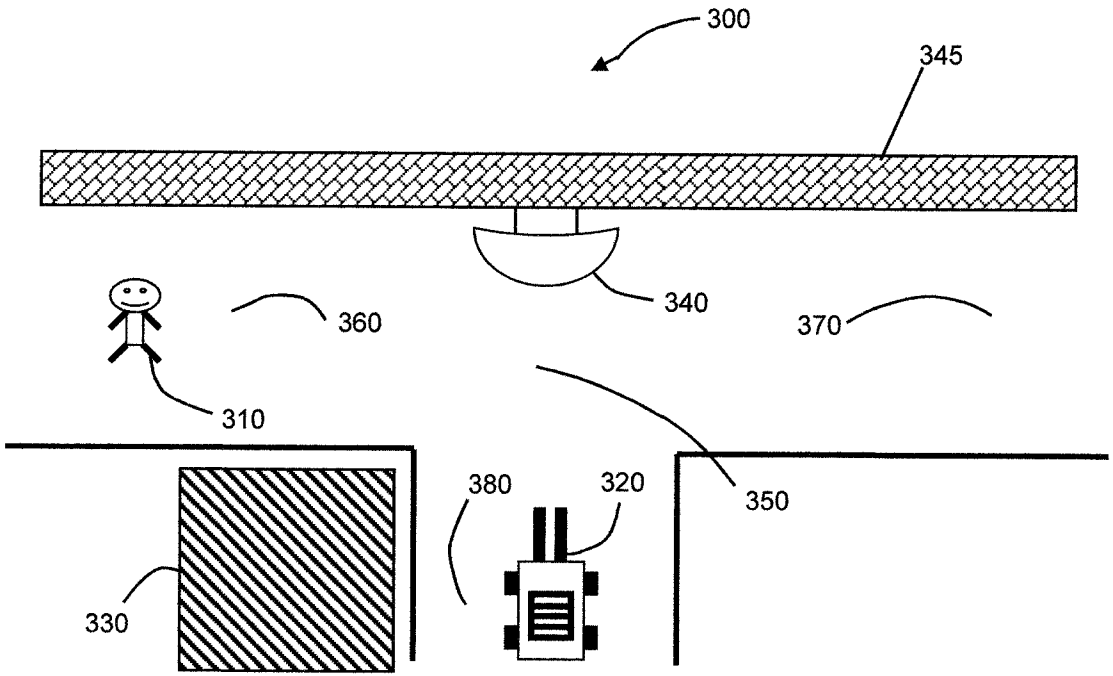
FIG. 3 is a top view diagram of a three way intersection in which the invention is utilized for providing warning information to an individual pedestrian and a forklift vehicle operator according to one invention embodiment.

It is also contemplated an apparatus of the invention could be placed on a wall instead of being suspended over an intersection. For example, FIG. 3 shows a configuration 300 wherein a person 310 is walking and a powered industrial truck 320 is approaching an intersection 350 shaped like a "T" with obstruction 330 obstructing their view of each other. The apparatus 340 is mounted on a wall 345 opposite one of the pathways leading into the intersection 350. The apparatus can function to warn the forklift 320 operator and the walking person 310 approaching the intersection 350 of each other's presence. The only requirement is that the sensors and the light producing system inside the apparatus 340 be realigned to detect traffic from the three directions of approach 360, 370, and 380 to the intersection 350 and to provide messages that are directed appropriately down the three directions of approach 360, 370, and 380.

Figure 4:
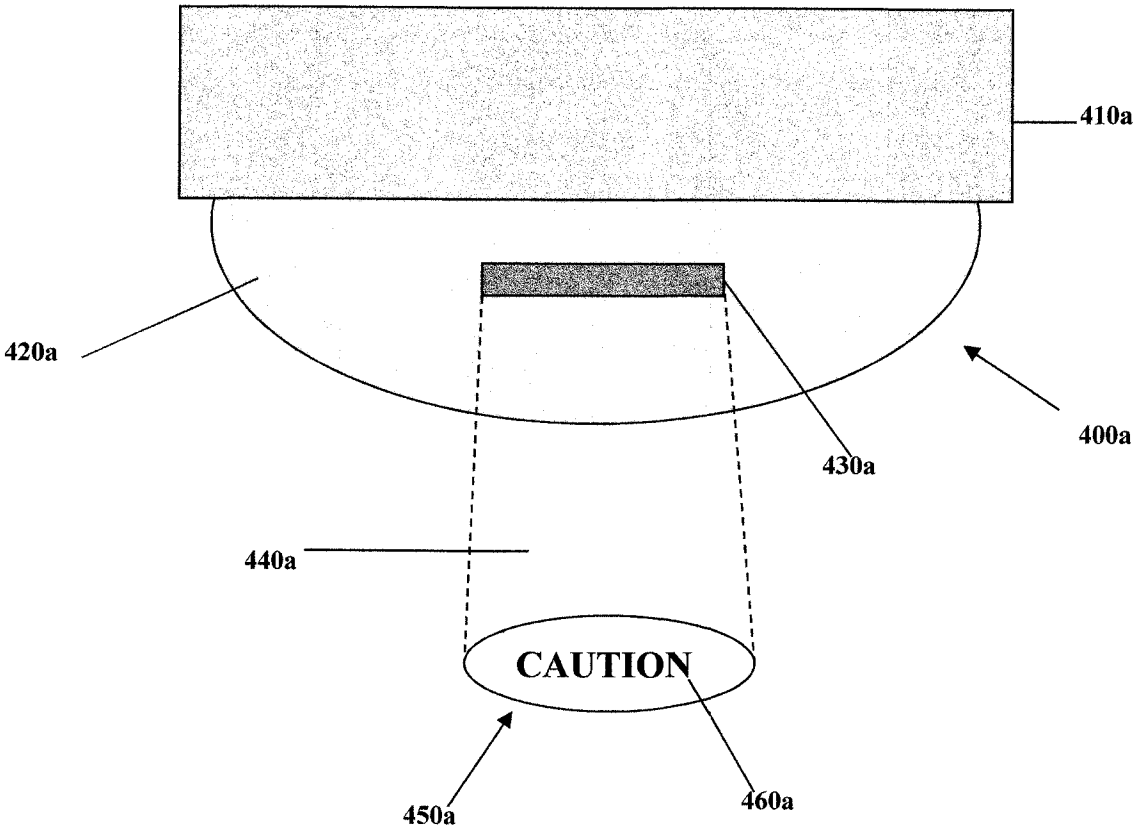
FIG. 4 is a side view of an apparatus projecting a warning message on an external surface according to one embodiment of the invention.

The invention contemplates that the light producing system can also project visible warning messages to surfaces external to the mirror dome. Referring to FIG. 4, an apparatus 400*a* of the invention is positioned with the partially transparent mirror dome 420*a* mounted to a ceiling 410*a*. An appropriately implemented mirror dome would include, as one example, any standard 36 inch or 48 inch 360 degree see-through dome such as the Mirrored Acrylic 360° Viewing Full Dome available from Se-Kure Domes and Mirrors, Inc. of Sturgis, Mich. Other mirrored or metallized mirror domes as are well known in the art could also be appropriately implemented. It is further contemplated that in some embodiments, a flat dome structure could be utilized, especially in embodiments, such as mounting on a wall, floor, or low ceiling where it is important that the apparatus of the invention be as flush with or as low as possible compared to features of the surrounding environment.

The mirror dome 420*a* includes an area of removed metallization 430*a* through which a light producing system comprising a message generator or projector (not shown in FIG. 4) can project light 440*a* through the mirror dome 420*a* to an external surface 450*a* separated from the mirror dome 420*a*. In the example of FIG. 4, the external surface 450*a* is the ground or floor beneath the ceiling 410*a*. The projector of the light producing system is positioned within the mirror dome 420*a* and below the ceiling 410*a*. An example of an appropriately implemented projector is the ADJ LED Message Projector available from American DJ Supply, Inc. of Los Angeles, Calif.

The apparatus 400*a* includes a sensing system (not shown in FIG. 4) that is in communication with the projector and which, upon identifying an approaching object or traffic, causes the projector to project the light 440*a* against the external surface 450*a*, the projected light 440*a* including a warning message 460*a*, in this case the word "CAUTION," visible on the external surface 450*a* to warn of the approaching object or traffic. Although the word "CAUTION" is shown as a warning message in this example, it will be appreciated that another warning message, such as the words "FORKLIFT" or "WARNING" or a graphical or picture image, possibly changing depending on sensed or detected objects, traffic or conditions, could also be projected, with all such variations being within the anticipated scope of the invention.

Figure 5:
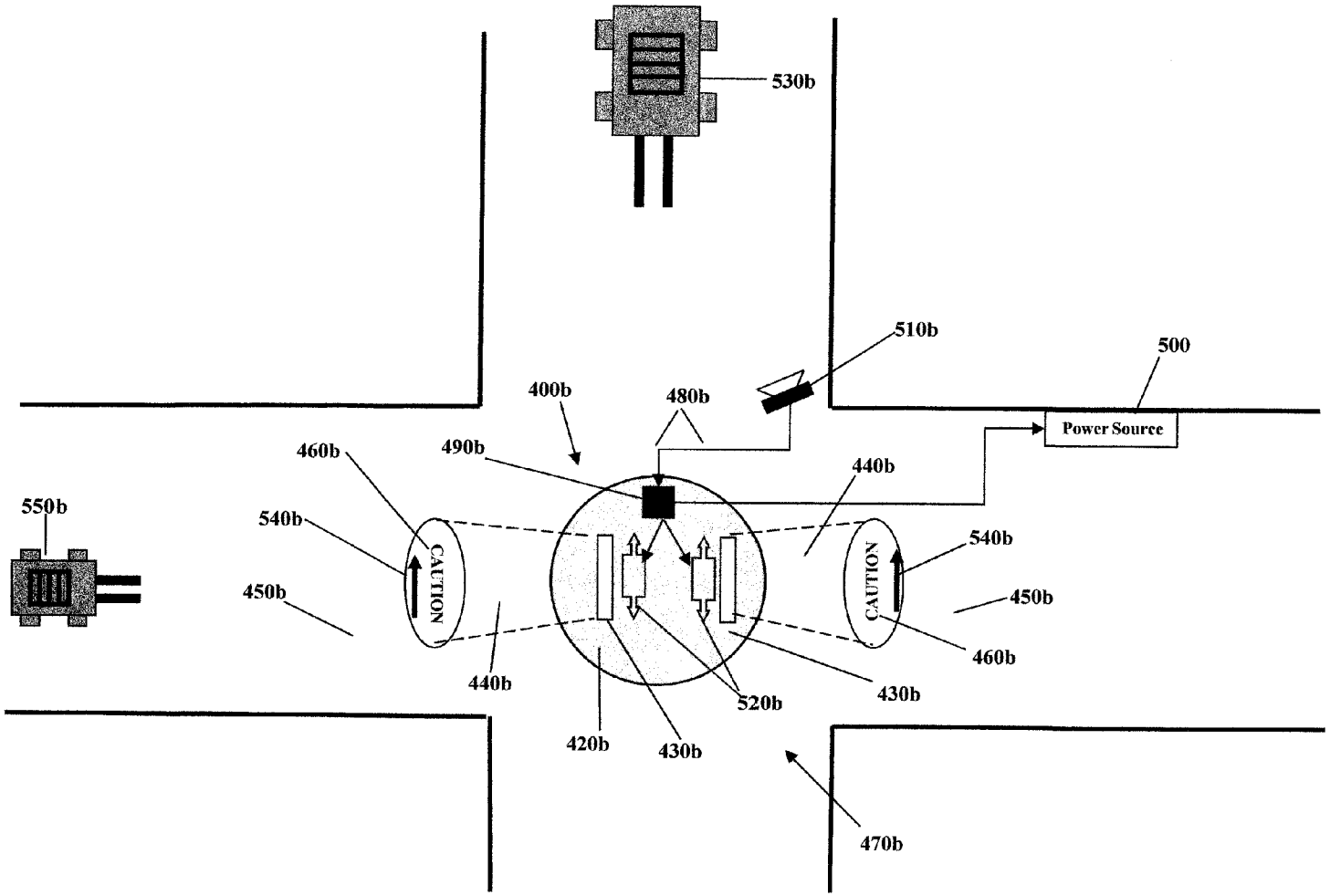
FIG. 5 is a top view diagram of a four way intersection in which the invention is being utilized for providing warning information to two forklift vehicle operators according to one embodiment of the invention.

FIG. 5 is a top view diagram of a four way intersection 470*b* in which an apparatus 400*b* of the invention is utilized for providing warning information to forklift vehicle operators approaching the intersection 470*b*. The sensing system 480*b* includes a controller 490*b* connected to a power source 500 and a microwave sensor 510*b*. An appropriately implemented controller, such as the BDWA-MW Bi-directional Worker Alert available from Alert Safety Products, Inc. of Cincinnati, Ohio, can include an appropriately implemented microwave sensor, or a separate sensor, such as the Herkules 2 Signal Generator, available from Bircher Reglomat A.G. of Beringen, Switzerland, can be added to another appropriate controller.

The controller 490*b* is positioned within a mirror dome 420*b* mounted on a ceiling (not shown in FIG. 5) over the intersection 470*b*. Also positioned within the mirror dome 420*b* is a light producing system which is in communication with the sensing system and which comprises two projectors 520*b*. Each projector 520*b* of the light producing system is capable of producing and projecting light 440*b* through areas of removed metallization 430*b* in the mirror dome 420*b* to create messages viewable on an external surface 450*b* separated from the mirror dome 420*b*, the external surface 450*b* in this case being the floor of the intersection 470*b*.

The sensing system is capable of identifying traffic crossing at the intersection 470*b* with the controller 490*b* which uses the microwave sensor 510*b* to identify the nature of approaching objects and traffic, to differentiate between metal and non-metal objects and traffic, and to differentiate between approaching and departing objects and traffic.

Consider the operator of a first forklift 530*b* approaching the intersection 470*b*. The microwave sensor 510*b* allows the sensing system to detect the approaching first forklift 530*a* and identify it as a potentially hazardous metal object moving in an approaching direction to the intersection 470*b*. The controller 490*b* responds to this information regarding the nature of the approaching traffic object to cause both projectors 520*b* to produce and project light 440*b* through the areas of removed metallization 430*b* to the positions on the floor 450*b* with both warning messages 460*b* in the form of the projected words "CAUTION" along with an arrow indicator 540*b* that indicates the direction from which the recognized hazard is approaching the intersection 470*b*.

Both the warning message 460*b* and arrow indicator 540*b* from one of the projectors 520*b* are visible on the floor 450*b* to the operator of a second forklift 530*b* that is also approaching the intersection 470*b* from a different direction, but possibly out of view of the first forklift 450*b* as it approaches. A warning message 460*b* and arrow indicator 540*b* from one of the projectors 520*b* would also be visible to the operator of another vehicle approaching the intersection 470*b* from a direction opposite that of the second forklift 530*b*.

It will be appreciated that additional detectors can be used to allow for detection of approaching objects and traffic from other directions as well and to allow for modifications to warning messages or other indicators accordingly.

For example, consider if the first forklift 530*b* had approached the intersection 470*b* from a direction opposite that depicted in FIG. 5, an additional microwave detector (not shown in FIG. 5) added to the sensing system but oriented to detect objects and traffic approaching the intersection 470*b* from the opposite direction, could be used to alert the controller 490*b* of the direction of approach so that the controller 490*b* would cause the projectors 520*b* to continue projecting the words "CAUTION" as warning messages, but also project an oppositely pointing arrow indicator (not shown in FIG. 5) to properly indicate the direction from which the detected hazard is approaching the intersection 470*b*.

Figure 6:
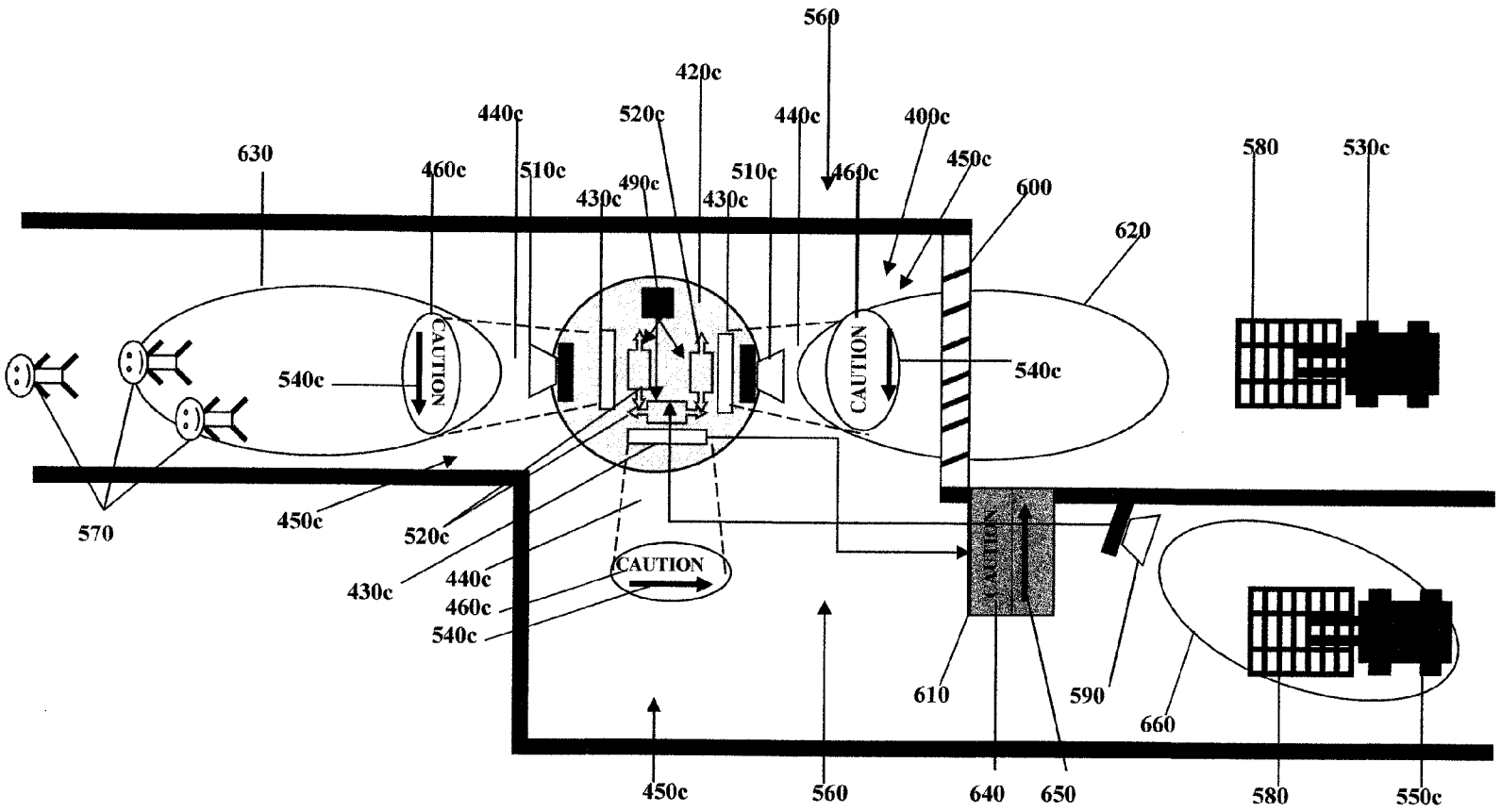
FIG. 6 is a top view diagram of a three way intersection in which the invention is being utilized for providing warning information to multiple pedestrians and forklift vehicle operators according to one invention embodiment.

It is further contemplated the invention can be implemented in more complex, unusual, or unfamiliar intersection situations as well. Consider the top view diagram of a three way intersection 560 in FIG. 6 in which the invention is utilized for providing warning information to multiple pedestrians 570 and the operators of first and second forklift vehicles 530*c* and 550*c* carrying pallets 580. The warning apparatus 400*c* includes a light producing system having three projectors 520*c* positioned within a mirror dome 420*c* suspended over the intersection 560, the mirror dome 420*c* including three areas of removed metallization 430*c* allowing the projectors 520*c* to project light 440*c* on to the external surface 450*c* below the apparatus 400*c*, in this case the floor of the intersection 560. The light producing system further includes a remotely positioned and operated illuminated warning sign 610 positioned on a wall or ceiling along the travel path of the approaching second forklift 550*c*. One example of an appropriately implemented illuminated warning sign 610 includes the LCS 20 LED Caution Sign available from Alert Safety Products, Inc. of Cincinnati, Ohio. Although the invention is shown and described in FIG. 6 with an illuminated warning sign 610 along the travel path of the second forklift 550*c*, it will be appreciated that a projector similar to those projectors 520*c* positioned within the mirror dome 420*c* or other like remotely operable warning devices could also be used in place of and in the depicted location of the illuminated warning sign 610, all within the anticipated scope of the invention.

A sensing system is in communication with the light producing system via the controller 490*c*, which is also positioned within the mirror dome 420*c*. The sensing system includes two dome-mounted microwave sensors 510*c* positioned to detect the presence of traffic and objects along the travel paths of the approaching pedestrians 570 and the first forklift 530*c*, the first forklift 530*c* approaching the intersection 560 which is located behind an overhead door 600. The sensing system further includes a third, remotely positioned microwave sensor 590 positioned on a wall or ceiling to detect the presence of traffic and objects along the travel path of the approaching second forklift 550*c*.

Consider the first forklift 530*c* as it approaches the overhead door 600 and intersection 560. An additional sensor (not shown) on the overhead door 600 detects the first forklift 530*c* as it approaches the door 600 and instructs the door 600 to open. It is contemplated that in some embodiments, the sensor on the door 600 may be in direct communication with the controller 490*c* or the sensing system of the apparatus 400*c*, and in some embodiments, the operation of the door 600 will initiate operation of the sensing system and projectors 430*c*.

Regardless, as the first forklift 530*c* approaches the opening door 600, the forklift 530*c* will be within line of sight of the apparatus 400*c* and will enter a first sensor detection range 620, becoming detectable by the sensing system of the apparatus 400*c*. For comparison, a second sensor detection range 630 is also shown that would represent the detectable range had the forklift 530*c* approached the apparatus 400*c* from the opposite direction, i.e. the direction of approach by pedestrians 570. The sensing system, via the microwave sensors 510*c* and logic of the controller 490*c*, can distinguish between non-metal objects and traffic such as the pedestrians 570 and metal objects and traffic such as the first and second forklifts 530*c* and 550*c*.

The controller 490*c*, sensing the presence of the first forklift 530*c* will cause one projector 520*c* to produce and project a warning message 460*c*, which is the word "CAUTION" visible on the external surface 450*c* of the floor in the direction of the approach of the second forklift 550*c*. The controller 490*c* will also cause the same projector 520*c* to generate an arrow indicator 540*c*, also visible on the external surface 450*c* of the floor, to indicate to the driver of the second forklift 550*c* the direction from which the hazard of the first forklift 530*c* is originating. However, due to the 90 degree turn that would be involved and the longer distance before the second forklift 550*c* would encounter the first warning message 460*c* and arrow indicator 540*c*, an additional warning to the operator of the second forklift 550*c* would be useful.

For this reason, the controller also remotely operates the illuminated warning sign 610, including an illuminated warning 640, i.e. the word "CAUTION," and an illuminated arrow indicator 650. The warning sign 610 therefore indicates the presence of and direction from which the hazard of the first forklift 530*c* is originating well before the second forklift 550*c* arrives at the area of the intersection 560 under the apparatus 400*c*.

As the second forklift 550*c* approaches the intersection 560, the second forklift 550*c* enters a remote sensor detection range 660 becoming detectable to the sensing system via the remotely positioned microwave sensor 590. In response to the detected second forklift 550*c*, the controller 490*c* causes the projectors 520*c* to produce and project warning messages 460*c*, with the word "CAUTION" visible on the external surfaces 450*c* of the floor in the direction of the approach of the first forklift 530*c* and in the direction of the approach by the pedestrians 570. The controller 490*c* also causes the same projectors 520*c* to generate arrow indicators 540*c*, also visible on the external surfaces 450*c* of the floor, to indicate to the driver of the first forklift 530*c* and the pedestrians 570 the direction from which the hazard of the second forklift 550*c* is originating.

Figure 7:
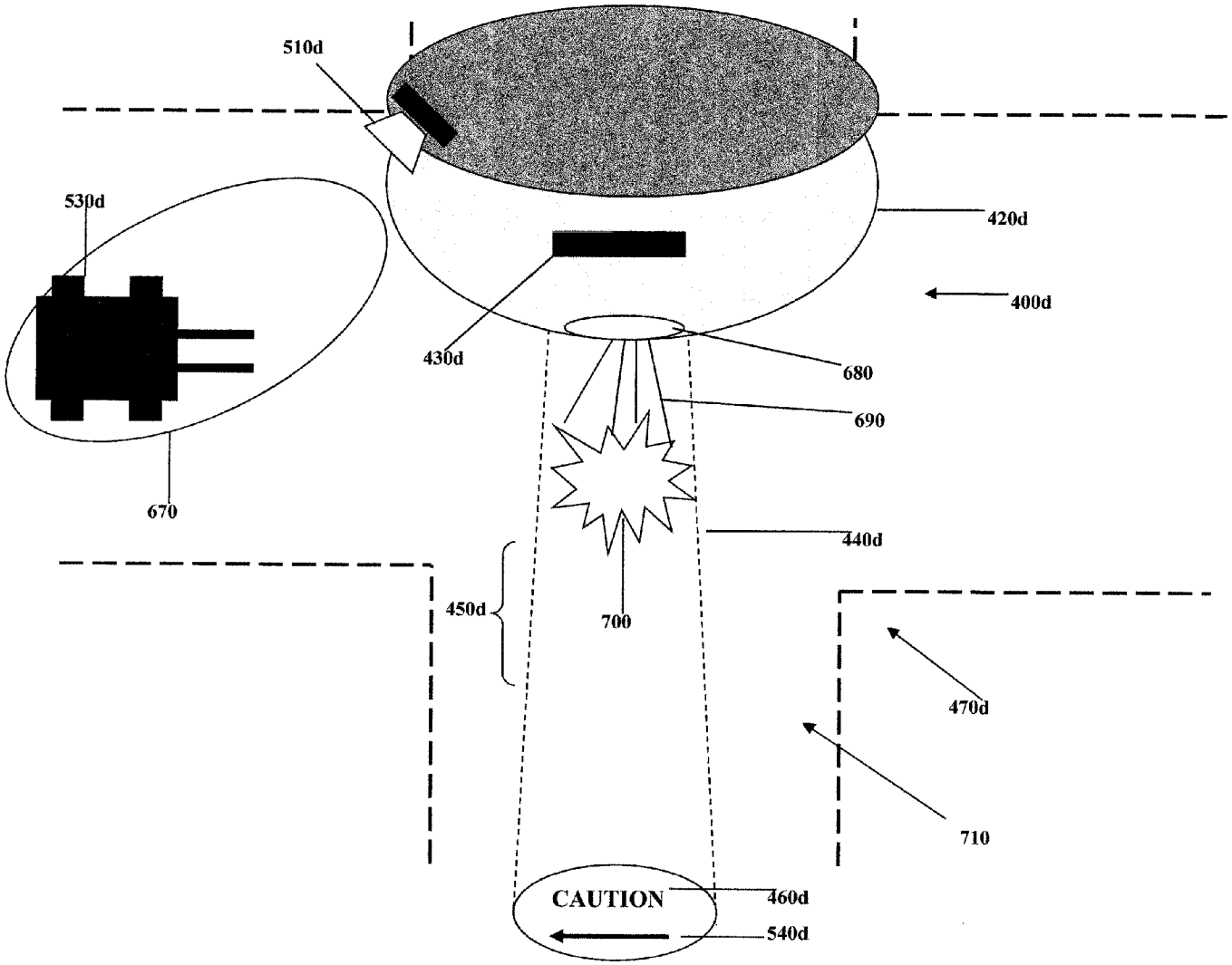
FIG. 7 depicts an apparatus projecting both a warning message and an alert beam of light on an external surface according to one embodiment of the invention.

It will be further appreciated that additional types of warning projections are contemplated within the intended scope of the invention. FIG. 7 depicts a contemplated apparatus 400*d* of the invention suspended above a four way intersection 470*d* in which a mirror dome 420*d* includes an area of removed metallization 430*d* through which a projector (not shown in FIG. 7) produces light 440*d* to project a warning message 460*d* and an arrow indicator 540*d* visible on the external surfaces 450*d* of the floor of the intersection 470*d* when a microwave sensor 510*d* of the apparatus 400*d* detects a first forklift 530*d* is approaching the intersection 470*d* as the forklift 530*d* enters the senor detection range 670.

The mirror dome 420*d* includes an additional bottom area of removed metallization 680 through which the light producing system projects an additional alert beam 690 to create a light spot 700 on the external surface 450*d* of the floor approximately directly below the suspended position of the mirror dome 420*d*. The light producing system may create the additional alert beam 690 and light spot 700 with an additional LED or other appropriate light (not shown in FIG. 7) positioned within the mirror dome 420*d* to project light downward and through the bottom area of removed metallization 680. In the case of the embodiment shown and described in FIG. 7, the alert beam 690 and light spot 700 would serve as an additional visual alert, supplementing the projected warning message 460*d* and arrow indicator 540*d*. In this embodiment, while the projected warning message 460*d* and arrow indicator 540*d* would serve to alert pedestrians and traffic approaching the apparatus 400*d* from a perpendicular direction of approach 710 of the oncoming hazard of the approaching first forklift 530*d*, the alert beam 690 and light spot 700 would serve as separate warnings to those already in or near the intersection 470*d* itself. Although this combination and arrangement of separate signal types projected from within the mirror dome 420*d* is show and described, it will be appreciated that many such combinations of projected signals and locations or directions of projection are possible and are contemplated to be within the anticipated scope of the invention.

In yet other contemplated embodiments the invention can be used in advertising and surveillance in various situations. These can be in commercial, surveillance, and other situations where people or equipment move or interact in some way.

In one contemplated embodiment, the apparatus can be mounted in a retail environment for the purpose of surveillance of areas where retail establishment employees cannot easily see what customers are doing. Such apparatus of the invention can be loaded with messages that are appropriate for the retail environment and when movement is made in the direction of the apparatus messages appropriate for the situation can be presented using the light producing system. These messages can serve a variety of purposes. They can make the customer take note of the presence of the surveillance mirror; they can be used to draw particular attention to products or services that the retail establishment wants to advertise by creating an appropriate image using the light producing system; and they can alert retail staff to the presence of customers near the apparatus so that the staff can observe customers using the mirror. Of course, the sensors and light producing system would in such cases be optimally and appropriately directed for the particular situation. If a computer resident in the apparatus is used to make decisions about messages, to generate messages or to take data, it would often require appropriate programming In other contemplated embodiments, the messages presented or projected through the mirror can also be triggered using external switches and be set to flash or otherwise draw the attention of those in the particular environment in which the apparatus is mounted. For example at a lunch counter or in a bar the apparatus can be mounted so that whenever someone takes a seat, a seat switch causes the light producing system to present or project a flashing message encouraging the customer to buy a particular product such as, "Apple Pie" and at the same time providing an object of visual interest to the customer and a security system for the staff.

Those skilled in the art will realize that this invention is capable of embodiments different from those shown and described. It will be appreciated that the detail of the structure of this apparatus and methodology can be changed in various ways without departing from the scope of this invention. Accordingly, the drawings and detailed description of the preferred embodiments are to be regarded as including such equivalents as do not depart from the scope of the invention.

The invention claimed is:

1. An apparatus for seeing and for warning traffic crossing at an intersection comprising:

a partially transparent mirror dome having an outside surface for reflecting incident light and an inside surface for receiving light from inside said mirror dome and passing the light through said mirror dome;

a light producing system for producing and transmitting light through said mirror dome wherein the light is projected through said mirror dome to an external surface separated from said mirror dome, said light producing system producing a message with the light projected through said mirror dome that is viewable on the external surface;

a sensing system for identifying traffic crossing at the intersection, said sensing system having a microwave sensor to identify the nature of approaching objects and traffic, said apparatus differentiating between metal and non-metal objects and traffic and further differentiating between approaching and departing objects and traffic; and said sensing system being in communication with said light producing system to cause said light producing system to produce and project a message viewable on the external surface separated from said mirror dome when said sensing system detects approaching objects or traffic, the message provided and projected by said light producing system indicating the direction of approaching traffic and object travel.

2. The apparatus of claim 1 wherein the message provided and projected by said light producing system further indicating information regarding approaching traffic and objects.

3. The apparatus of claim 1 wherein said mirror dome includes a reflective metallization and an area of removed metallization, said light producing system being positioned to project light through said mirror dome through said area of removed metallization.

4. The apparatus of claim 1 wherein said light producing system projects an alert beam of light on an external surface separated from said mirror dome when said sensing system detects approaching objects or traffic.

5. The apparatus of claim 4 wherein said light producing system projects the alert beam of light with an LED light.

6. The apparatus of claim 4 wherein said mirror dome includes a reflective metallization and an area of removed metallization, said light producing system being positioned to project the alert beam of light through said mirror dome through said area of removed metallization.

7. The apparatus of claim 1 wherein said mirror dome is flat.

8. The apparatus of claim 1 wherein said light producing system further includes a remotely positioned illuminated warning sign.

9. The apparatus of claim 1 wherein said sensing system includes a remotely positioned microwave sensor.

10. An apparatus for seeing and for warning traffic crossing at an intersection comprising:

a partially transparent mirror dome having an outside surface for reflecting incident light and an inside surface for receiving and passing light through said mirror dome;

a light producing system for producing and transmitting light through said mirror dome so that the light is projected through said mirror dome to an external surface separated from said mirror dome, said light producing system producing a message with the light projected through said mirror dome that is viewable on the external surface;

a sensing system for identifying traffic crossing at the intersection, said sensing system having a microwave sensor to identify the nature of approaching objects and traffic, said sensing system able to distinguish at least two of:

substantially metallic traffic;

substantially non-metallic traffic;

size of approaching traffic; and traffic approaching the mirror from traffic departing the mirror; in at least one direction for traffic crossing the intersection; and the sensing system comprising a logic system to determine warning messages and being in communication with the light producing system causing the light producing system to project the warning messages to traffic crossing the intersection in other directions, the warning messages being visible when viewing the external surface separated from said mirror dome, the warning messages indicating the direction of approaching traffic and object travel.

11. The apparatus of claim 10 where said mirror dome allows said light producing system to project warning messages in a plurality of directions.

12. The apparatus of claim 11 where the mirror dome is substantially in the shape of a spherical dome to allow said light producing system to project warning messages in a plurality of directions.

13. The apparatus of claim 10 where said mirror dome comprises a plurality of surfaces having a plurality of curvatures.

14. The apparatus of claim 10 where said sensing system turns off the message when traffic moves away from the mirror dome and no other traffic is approaching the mirror dome from the same direction.

15. The apparatus of claim 10 where said mirror dome is flat.

16. The apparatus of claim 10 where the messages are turned off according to a preset period of time after the traffic is detected by said sensing system.

17. The apparatus of claim 10 further employing a sound alarm for audibly warning traffic in the vicinity of the intersection.

18. The apparatus of claim 10 where said light producing system comprises a laser.

19. The apparatus of claim 10 where said light producing system includes a projector utilizing light emitting diodes.

20. The apparatus of claim 10 further comprising:

said mirror dome includes a reflective metallization and an area of removed metallization; and said light producing system being positioned to project light through said mirror dome through said area of removed metallization.

21. The apparatus of claim 10 further comprising an indicator to indicate the operational status of said apparatus.

22. The apparatus of claim 10 where discriminators are placed on selected traffic to identify the traffic.

23. The apparatus of claim 10 where said light system displays no message if no moving traffic is detected.

24. The apparatus of claim 10 where a pass message is displayed if no traffic is detected approaching the intersection.

25. The apparatus of claim 10 comprising circuitry that receives data from said sensing system and displays at least one of the following: type; size; proximity to the intersection; speed; and image of traffic approaching the intersection.

26. The apparatus of claim 10 wherein all components comprising said apparatus are mounted in a single unitary package.

27. The apparatus of claim 10 further comprising:

a remote sensor positioned at a location outside said mirror dome, said remote sensor being further positioned to detect and relate the presence of traffic to said sensing system; and a remote signal positioned at a location outside said mirror dome, said remote signal being further positioned to display a warning message when said remote sensor detects the presence of traffic.

28. The apparatus of claim 27, wherein the warning message indicates the direction of approaching traffic and object travel and further indicates information regarding approaching traffic and objects.

29. The apparatus of claim 28 wherein said remote signal displays the warning message with an LED display.

30. The apparatus of claim 27 wherein said remote signal further comprises a remote projector, said remote projector being positioned to display the warning message on a surface that is separated from said remote signal.

31. The apparatus of claim 10 wherein said light producing system also projects an alert beam of light on a surface separated from said mirror dome when said sensing system detects approaching objects or traffic.

32. The apparatus of claim 31 wherein said light producing system projects the alert beam of light with an LED light.

33. The apparatus of claim 31 wherein said mirror dome includes a reflective metallization and an area of removed metallization, said light producing system being positioned to project the alert beam of light through said mirror dome through said area of removed metallization.

34. The apparatus of claim 10 wherein said sensing system includes a remotely positioned microwave sensor.

35. The apparatus of claim 10 wherein said light producing system includes a remotely positioned illuminated warning sign.

36. An apparatus for surveillance and advertising in commercial environments comprising:

a partially transparent mirror dome having an outside surface for reflecting incident light from outside said mirror dome and an inside surface for receiving light from inside said mirror dome and passing the light through said mirror dome;

a light producing system for producing and transmitting light through said mirror dome wherein the light is projected through said mirror dome to an external surface separated from said mirror dome, said light producing system producing messages with the light projected through said mirror dome that are viewable on the external surface; and a sensing system for identifying the approach of a customer toward said mirror dome, said sensing system having a microwave sensor to identify the nature of approaching objects and customer traffic, said apparatus differentiating between metal and non-metal objects and customer traffic and further differentiating between approaching and departing objects and customer traffic, said sensing system being in communication with said light producing system to cause said light producing system to produce and project messages viewable on the external surface separated from said mirror dome when said sensing system detects approaching objects and customer traffic approaching said mirror dome, the messages provided and projected by said light producing system indicating the direction of approaching traffic and object travel.

37. The apparatus of claim 36 wherein the message provided and projected by said light producing system further indicates information regarding approaching objects and customer traffic.

38. The apparatus of claim 36 wherein said mirror dome includes a reflective metallization and an area of removed metallization, said light producing system being positioned to project an alert beam of light through said mirror dome through said area of removed metallization.

39. The apparatus of claim 36 wherein said light producing system also projects an alert beam of light on an external surface separated from said mirror dome when said sensing system detects approaching objects or customer traffic.

40. The apparatus of claim 39 wherein said light producing system projects the alert beam of light with an LED light.

41. The apparatus of claim 36 wherein said mirror dome includes a reflective metallization and an area of removed metallization, said light producing system being positioned to project the alert beam of light through said mirror dome through said area of removed metallization.

* * * * *